United States Patent [19]

Spradlin

[11] 4,058,313

[45] Nov. 15, 1977

[54] GOLF GAME

[76] Inventor: Fred Spradlin, P.O. Box 1054, Bonita Springs, Fla. 33923

[21] Appl. No.: 689,361

[22] Filed: May 24, 1976

[51] Int. Cl.[2] ..... A63F 7/06

[52] U.S. Cl. ..... 273/87.4

[58] Field of Search ..... 273/87, 87.2, 87.4, 273/129 HA, 176 B

[56] References Cited

U.S. PATENT DOCUMENTS

| | | | |
|---|---|---|---|
| 731,825 | 6/1903 | Voorhees | 273/87.4 |
| 1,561,178 | 11/1925 | McGrann | 273/87.2 |
| 1,591,095 | 7/1926 | Meyer | 273/87 C X |
| 1,875,198 | 8/1932 | Nagai | 273/87 B |
| 2,014,992 | 9/1935 | Stayton | 273/87.4 |
| 3,054,615 | 9/1962 | Budish | 273/87.4 |
| 3,190,653 | 6/1965 | Karthaus | 273/87.4 |

FOREIGN PATENT DOCUMENTS

| | | | |
|---|---|---|---|
| 451,022 | 8/1949 | Italy | 273/129 HA |

*Primary Examiner*—Paul E. Shapiro
*Attorney, Agent, or Firm*—Allen D. Brufsky

[57] ABSTRACT

A table top golf game comprising a miniature player with a swingable club, a ball, a golf course with sand and water traps, trees and hedges, and an underneath ball return system.

7 Claims, 7 Drawing Figures

FIG.1
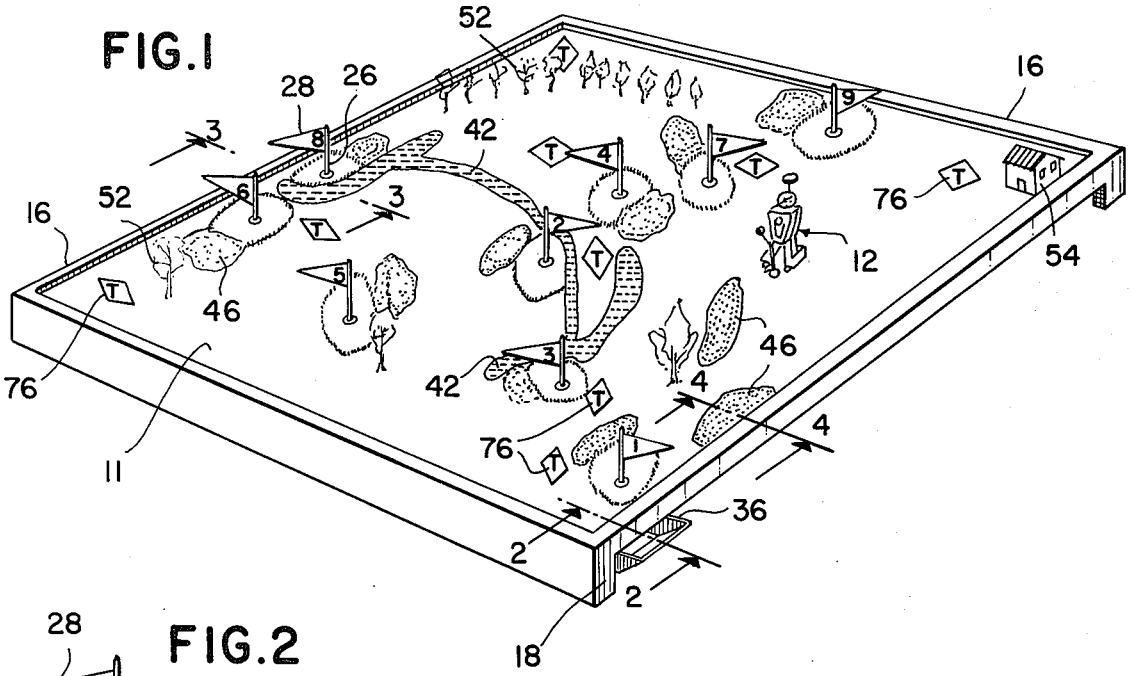
FIG.2
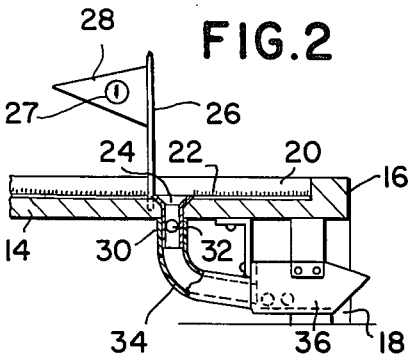
FIG.3
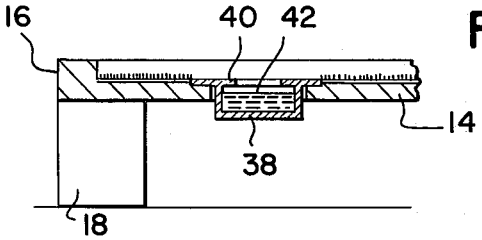
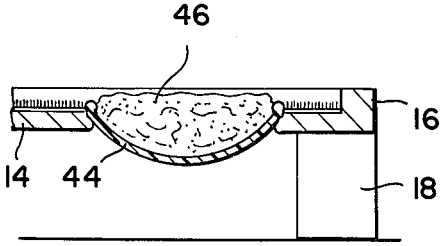
FIG.4
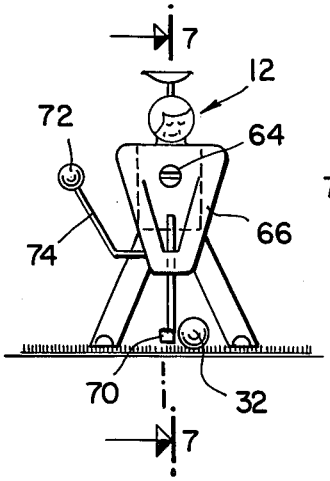
FIG.6
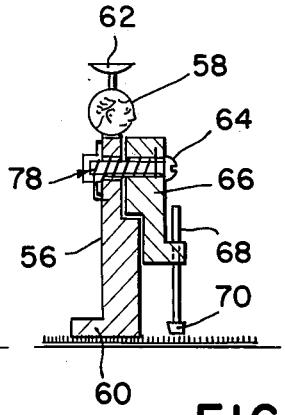
FIG.7
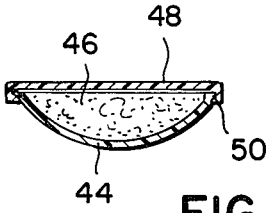
FIG.5

GOLF GAME

BACKGROUND OF THE INVENTION

1. Field of the Invention

This invention relates to indoor miniature simulated golf games and, in particular to games including swingable golf clubs, and sand and water traps.

2. Description of the Prior Art

The current game of golf has long been simulated by miniature indoor games. Of particular interest are the devices and games disclosed by Heinzelmann in U.S. Pat. No. 2,118,084 and by Lippert in U.S. Pat. No. 3,598,412. Heinzelmann's game is limited by the relatively fixed location of his ball striking device. Lippert discloses an interesting ball striker but without a supporting game.

SUMMARY OF THE INVENTION

It is therefore an object of this invention to overcome the limitations and disadvantages in the miniature golf games in the prior art and currently available in the market.

One of the objects of the invention is to provide a golf game embodying improved principles of design and construction.

An important object of the invention is to provide a golf game device which is comprised of a number of simple parts and components which can be economically manufactured and readily assembled.

A significant object of the invention is to provide a golf game device, so designed and constructed that it can be readily applied to almost any typical environment, indoors or out, now in use.

Another object of the invention is to provide a realistic golf game, simulating not only the appearance of a golf course, but simulating many of the problems of a golfer encounters on a full size course.

A further object of the invention is to provide real sand and water traps so that an attempt can be made to play out of the trap.

Yet another object of the invention is to provide a realistic ball hitting device.

A golf game, according to the principles of the invention, comprises a miniature player having a swingable club, a ball, a realistic golf course including sand and water traps, and topological features, and an underneath ball return system.

Further objects and advantages of this invention will appear more clearly from the following description of a non-limiting illustrative embodiment and the accompanying drawings in which like numerals designate like parts throughout the several views.

DESCRIPTION OF DRAWINGS

Briefly summarized, a preferred embodiment of the invention is described in conjunction with an illustrative disclosure thereof in the accompanying drawings, in which:

FIG. 1 is a pictorial representation of the golf game according to the principles of this invention.

FIG. 2 is a partial sectional view taken substantially along line 2 in FIG. 1 and showing a ball return system FIG. 3 is a partial sectional view taken substantially along line 3 in FIG. 1 and showing a water trap.

FIG. 4 is a partial sectinal view taken substantially along line 4 in FIG. 1 and showing a sand trap.

FIG. 5 is a view of a sand trap provided with a cover.

FIG. 6 is a front elevation view of a miniature player.

FIG. 7 is a sectional view taken substantially along plane 7—7 in FIG. 6 of a miniature player.

DESCRIPTION OF TYPICAL EMBODIMENT

In the drawings a miniature golf game 11 embodying features of the invention is illustrated comprised of a player 12 and a playable golf course on structural support board 14 with reenforcing edges 16 which restrict the ball 30 to the playing surface 22 in the recess 20 and with feet or edges 18 which clear the floor or table upon which the game rests in play. The playing surface 22 may have simulated grass, water 42 in traps 38 with lips 40 to reduce spillage, sand 46 in cup 44 which may be provided with cover 48 to swap over lips 50.

Each "hole" is compressed of a tie 76, a course with hazards such as trees 52, sand traps 44, water traps 38, hedges, with the objective a cupped hole 24 with a marker numbered 27 flag 28 on a pole 26. The ball 30 enters cup 24 and descends through tube 32, but tube 34, into collector 36 from which the ball may be retrieved — a complete underneath ball return system — necessitated by the very small size of the ball 30.

A club house 54 may be provided which may also function as a storage location.

The miniature player 12 with swingable club 68 with impact head 70 held in simulated arm 66 pivoted on fastener 64 mounted in stationary body 56 having feet 60 and topped by head 58 provided with a hold down pressure point 62 which may conveniently be cup-shaped to embrace a human finger tip. The swingable arm 66 has an extended puller 74 which may have a knob 72 on its end for easy holding. Arm 66 may be based by an elastic energy storage device 78 such as a rubber band or a spring.

The game may be played with any known golf association rules, or special rules may be composed.

The components of the game may be manufactured by known methods of known materials including pressed wood for the structural support 14, wood, metal or plastic for edges 18 and 16, plastic or metal for traps and cups, and the player may be made of wood, plastic or metal.

This game is educational, a training device, and therapeutic for sedentary individuals.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. A miniature table top game comprising at least one miniature player and a golf course including a structural supporting surface, bounding reenforcing edges, simulated grass surface, at least one sand trap, at least one water trap, and an underneath ball return system, the water trap comprising a removable water container having at least one anti spill upper lip, for insertion into a matching cutout in the structural surface.

2. A game as in claim 1 wherein the player comprises an upright simulated body and head pressure restraining point and a swingable golf club pivotally mounted to the body and having a club pulling mechanism and elastic energy storage means.

3. A game as in claim 2 wherein the energy storage means is a spring.

4. A game as in claim 2 wherein the energy storage means is a rubber band.

5. A game as in claim 1 wherein the sand trap comprises a removable container, for insertion into a matching cutout in the structural surface.

6. A game as in claim 5 wherein the sand trap further comprises a removable cover.

7. A game as in claim 1 further comprising at least one ball.

* * * * *